US009402440B2

(12) United States Patent
Diepenbrock

(10) Patent No.: US 9,402,440 B2
(45) **Date of Patent: *Aug. 2, 2016**

(54) CUSHIONING SOLE FOR SHOE

(71) Applicant: Nike, Inc., Beaverton, OR (US)

(72) Inventor: James E. Diepenbrock, Aloha, OR (US)

(73) Assignee: NIKE, Inc., Beaverton, OR (US)

( * ) Notice: Subject to any disclaimer, the term of this patent is extended or adjusted under 35 U.S.C. 154(b) by 219 days.

This patent is subject to a terminal disclaimer.

(21) Appl. No.: 14/075,298

(22) Filed: Nov. 8, 2013

(65) Prior Publication Data

US 2014/0059884 A1 Mar. 6, 2014

Related U.S. Application Data

(63) Continuation of application No. 12/833,379, filed on Jul. 9, 2010, now Pat. No. 8,578,630.

(51) Int. Cl.

| | |
|---|---|
| ***A43B 17/00*** | (2006.01) |
| ***A43B 13/18*** | (2006.01) |
| ***A43B 3/00*** | (2006.01) |
| ***A43B 7/14*** | (2006.01) |

(52) U.S. Cl.

CPC ..... *A43B 13/181* (2013.01); *A43B 3/0042* (2013.01); *A43B 7/144* (2013.01); *A43B 7/1445* (2013.01); *A43B 13/186* (2013.01); *A43B 17/00* (2013.01)

(58) Field of Classification Search

CPC ..... A43B 13/38; A43B 17/00; A43B 13/00; A43B 13/14; A43B 3/0042; A43B 7/146

USPC ..... 36/59 R, 59 C, 25 R, 114, 43, 44, 71, 36/141; D2/951–960

See application file for complete search history.

(56) References Cited

U.S. PATENT DOCUMENTS

| | | | | | |
|---|---|---|---|---|---|
| 1,517,610 | A | * | 12/1924 | Bayless | A43B 17/08 36/22 R |
| 3,006,085 | A | | 10/1961 | Bingham, Jr. | |
| D201,952 | S | | 8/1965 | Johns | |
| 3,722,113 | A | * | 3/1973 | Birkenstock | A43B 7/141 36/11.5 |
| 3,757,774 | A | * | 9/1973 | Hatuno | A43B 3/128 36/141 |
| 4,075,772 | A | * | 2/1978 | Sicurella | A43B 7/141 36/11.5 |
| 4,095,353 | A | * | 6/1978 | Foldes | A43B 13/38 36/11.5 |
| 4,534,121 | A | * | 8/1985 | Autry | A43B 7/142 36/35 R |
| 4,653,206 | A | * | 3/1987 | Tanel | A43C 13/04 36/126 |
| 4,897,937 | A | * | 2/1990 | Misevich | A43B 7/1425 36/140 |
| 5,203,097 | A | * | 4/1993 | Blair | A43B 13/223 36/114 |
| 5,313,718 | A | | 5/1994 | McMahon et al. | |
| 5,469,639 | A | | 11/1995 | Sessa | |
| 5,509,218 | A | | 4/1996 | Arcan et al. | |

(Continued)

*Primary Examiner* — Marie Bays

(74) *Attorney, Agent, or Firm* — Shook, Hardy & Bacon L.L.P.

(57) ABSTRACT

A sole in accordance with the present invention may include a sole for attachment to an outside of a shoe. Moreover, a sole of the present invention may include a sole for insertion within an inner cavity formed by an upper of a shoe. In exemplary aspects the sole includes a base and a plurality of protrusions projecting from the base and integrally constructed with the base. Protrusions may include a side extending at an angle from the base. In addition, protrusions may include a side extending near perpendicular from the base. A plurality of protrusions may be arranged at ball portions of the sole. In addition, a plurality of protrusions may be arranged at a heel portion of the sole.

18 Claims, 8 Drawing Sheets

(56) References Cited

U.S. PATENT DOCUMENTS

| | | | | |
|---|---|---|---|---|
| 6,101,746 | A | 8/2000 | Evans | |
| D458,739 | S | 6/2002 | Merceron | |
| 8,578,630 | B2 * | 11/2013 | Diepenbrock | A43B 7/144 36/25 R |
| 2001/0045028 | A1 * | 11/2001 | Crane | A43B 7/1415 36/44 |
| 2002/0166263 | A1 | 11/2002 | Sink | |
| 2003/0024134 | A1 * | 2/2003 | Howlett | A43B 13/181 36/43 |
| 2005/0257402 | A1 | 11/2005 | Kobayashi | |
| 2006/0026865 | A1 * | 2/2006 | Grisoni | A43B 17/026 36/43 |
| 2007/0017124 | A1 | 1/2007 | Koo et al. | |
| 2010/0257755 | A1 | 10/2010 | Gerber | |

* cited by examiner

CUSHIONING SOLE FOR SHOE

CROSS-REFERENCE TO RELATED APPLICATIONS

This application is a Continuation from currently pending U.S. application Ser. No. 12/833,379, filed on Jul. 9, 2010, and similarly entitled CUSHIONING SOLE FOR SHOE, the entirety of which is incorporated by reference herein.

TECHNICAL FIELD

The present invention relates generally to a sole for a shoe, such as an insole or an outsole for a shoe that provides cushioning for a wearer.

BACKGROUND

During various activities an individual's feet often bear the initial shock from impact with the ground or floor, which may subsequently be distributed throughout various portions of the individual's body. Athletic endeavors especially may produce particularly strong forces against the individual's body. Shoes may be worn on an individual's feet to provide support and cushion against forces from impact.

SUMMARY

This Summary is provided to introduce a selection of concepts in a simplified form that are further described below in the Detailed Description. This Summary is not intended to identify key features or essential features of the claimed subject matter, nor is it intended to be used in isolation as an aid in determining the scope of the claimed subject matter.

The present invention offers several practical applications in the technical arts including, but not limited to, one or more soles for use with a shoe. A shoe may generally be constructed of a variety of components. For example, a shoe may include an "upper" designed to enclose and support a wearer's foot. In addition, a shoe may include an energy-absorbing "midsole" coupled to the upper. Finally, a shoe may include a ground-contacting outsole component which may be coupled to an underneath side of the midsole.

A sole in accordance with the present invention might include a sole for attachment to an outside of a shoe, such as to an underneath side of a midsole. In addition, a sole of the present invention might include a sole for insertion within an inner cavity formed by an upper of a shoe. A sole in accordance with the present invention serves a variety of functions. For example, among other things, a sole in accordance with the present invention might provide cushion, protection, resilience, shock-absorption, responsiveness, rigidity, etc., for a wearer of the shoe. A sole in accordance with the present invention may provide a base and a plurality of protrusions projecting from the base and integrally constructed with the base. Protrusions may include a side extending at an angle from the base and a side extending near perpendicular from the base. The protrusions may serve to absorb the shock of impact with the ground or floor during an activity.

Additional objects, advantages, and novel features of the invention will be set forth in part in the description which follows, and in part will become apparent to those skilled in the art upon examination of the following, or may be learned by practice of the invention.

BRIEF DESCRIPTION OF THE SEVERAL VIEWS OF THE DRAWING

A detailed description of the invention is provided below with reference to the attached drawing figures, wherein.

DETAILED DESCRIPTION

Figure 1:
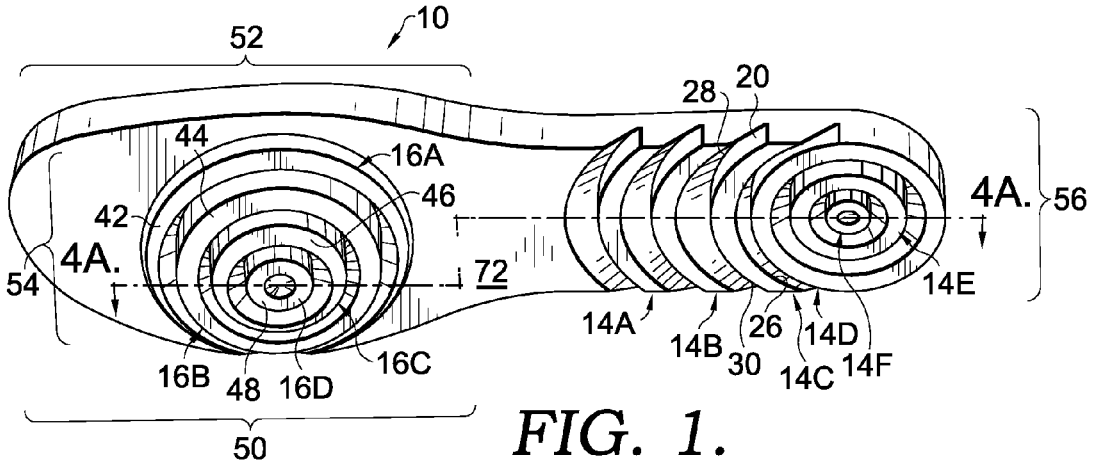
FIG. 1 illustrates, from a perspective view, a sole in accordance with an embodiment of the invention.
Figure 2:
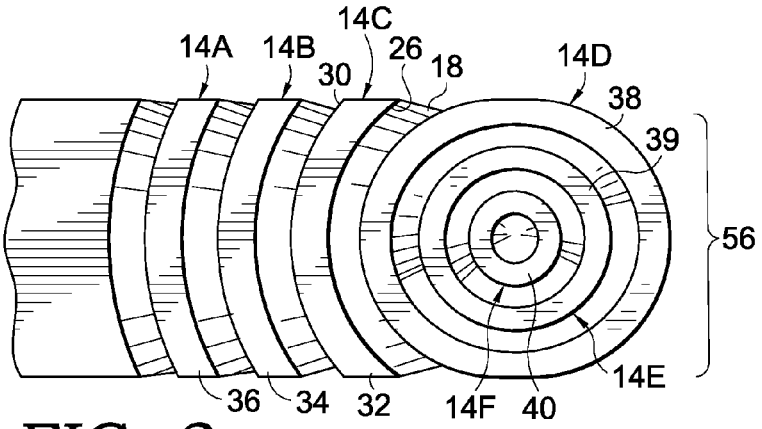
FIG. 2 illustrates, from a direct view, an embodiment of a heel portion of a sole in accordance with an embodiment of the invention.

The subject matter of the present invention is described with specificity herein to meet statutory requirements. However, the description itself is not intended to limit the scope of this patent. Rather, the inventors have contemplated that the claimed subject mater might also be embodied in other ways in conjunction with other present or future technologies.

Exemplary embodiments of the invention provide a sole for a shoe. A sole in accordance with the present invention might be an integral part of a shoe or might be an insole insert that is positionable within, and if desired, removable from, the shoe. By way of example only, and not limitation, a sole in accordance with the present invention might be coupled to the outside of a shoe, such as to the underneath side of a shoe midsole, or may comprise the midsole itself. Moreover, a sole in accordance with the present invention might be integrally constructed with a midsole. In another embodiment, a sole might be inserted into an inner cavity formed by a shoe upper, such that the sole is positionable beneath the bottom of a wearer's foot when the shoe is worn.

Referring now to the drawings in general, and initially to FIGS. 1, 2, 3, 4A, and 4B, a sole 10 is shown in accordance with an embodiment of the present invention. In an exemplary embodiment, the sole 10 includes a base 12 and a plurality of protrusions 14A-14F and 16A-16D projecting from base 12 and integrally constructed with base 12.

An exemplary embodiment of protrusions in accordance with the present invention is illustrated by protrusion 14C, which includes various elements. For example, protrusion 14C includes an angled side 18 and a perpendicular side 20. In addition, the angled side 18 of protrusion 14C comprises a first connecting edge 24 adjacent to and extending along the base 12 and a first terminal edge 26 at the opposing edge of the angled side 18 from the first connecting edge 24. Moreover, the perpendicular side 20 comprises a second connecting edge 28 adjacent to and extending along the base 12 and a second terminal edge 30 at the opposing edge of the perpendicular side 20 from the second connecting edge 28. In one embodiment, the angled side 18 extends from the base 12 at an approximate thirty-degree angle 22. In another embodiment, the perpendicular side 20 extends at a near perpendicular angle from the base 12.

As shown in FIGS. 1, 4A, 5, and 6A in an example of a sole in accordance with the present invention, a plurality of protrusions are positioned or constructed adjacent one to another. For example, in FIGS. 1 and 4A protrusion 14C is adjacent to protrusion 14B. As a result, a connecting edge of protrusion 14B extends along the base 12 consistent with second connecting edge 28 of protrusion 14C. Accordingly, the angled side of protrusion 14B shares connecting edge 28 with a perpendicular side 20 of protrusion 14C.

Figure 4A:
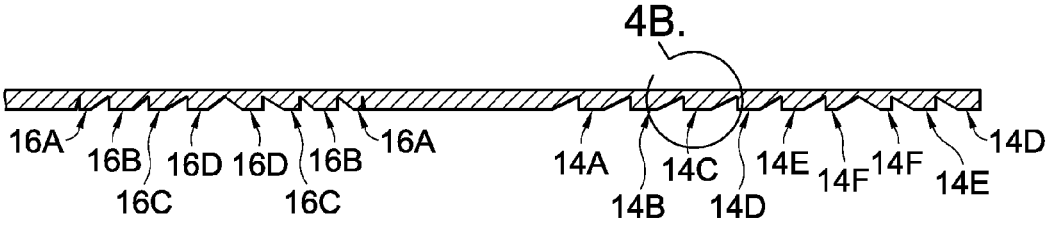
FIG. 4A illustrates a cross-sectional view of the sole illustrated in FIG. 1.
Figure 4B:
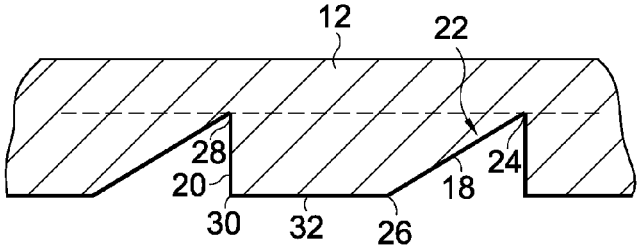
FIG. 4B illustrates a blown-up view of a portion of FIG. 4A.

Also illustrated in FIGS. 1 and 4A, in another example sole in accordance with the present invention, protrusion 14C further comprises a surface-facing side 32 extending substantially parallel to the base 12 between the first terminal edge 26 of the angled side 18 and the second terminal edge 30 of the perpendicular side 20.

Figure 5:
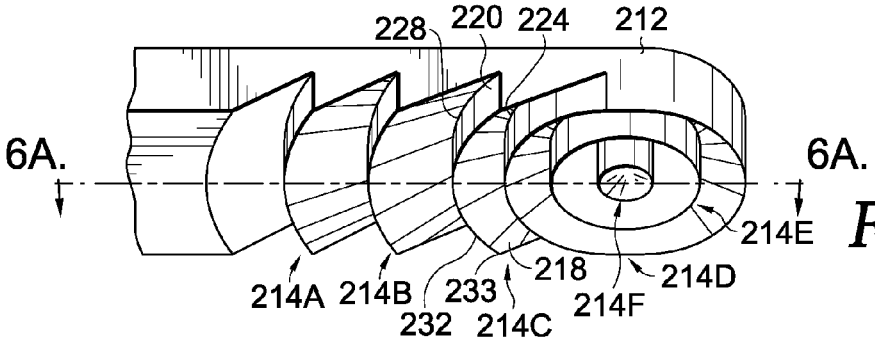
FIG. 5 illustrates, from a perspective view, a portion of a sole in accordance with an embodiment of the invention.
Figure 6A:
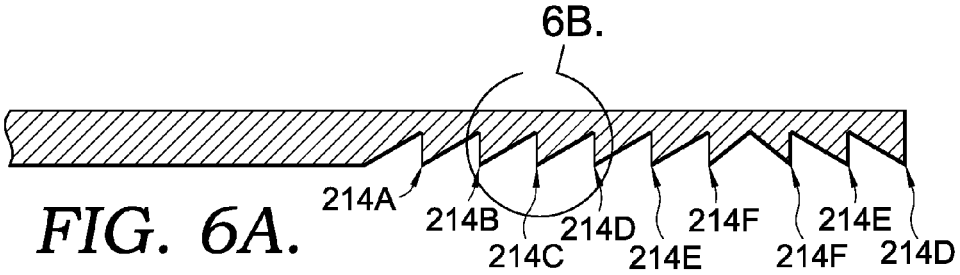
FIG. 6A illustrates a cross-sectional view of the portion illustrated in FIG. 5.
Figure 6B:
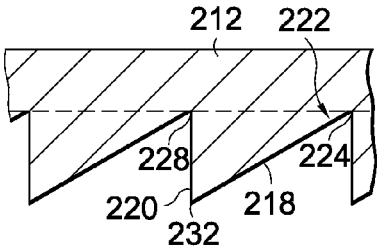
FIG. 6B illustrates a blown-up view of a portion of FIG. 6A.

An alternative sole in accordance with the present invention is illustrated in FIGS. 5, 6A and 6B, which illustrate exemplary protrusion 214C. Protrusion 214C may include various elements. For example, protrusion 214C includes an angled side 218 and a perpendicular side 220. The angled side 218 comprises a first connecting edge 224 adjacent to and extending along the base 212. Perpendicular side 220 further comprises a second connecting edge 228 adjacent to and extending along the base 212. Angled side 218 and perpendicular side 220 terminate at a shared termination edge 232. Shared termination edge 232 is opposite the first connecting edge 224 of the angled side 218 and is opposite the second connecting edge 228 of the perpendicular side 220. As a result, protrusion 214C terminates at a point 233.

With continued reference to FIGS. 5, 6A, and 6B, in a further example sole in accordance with the present invention a plurality of protrusions 214A-214F are positioned or constructed adjacent one to another along base 212. For example, protrusion 214B is adjacent to protrusion 214C. A first connecting edge of protrusion 214B is adjacent to, and extends along the base 212 consistent with, a second connecting edge 228 of protrusion 214C. As such, an angled side of protrusion 214B shares connecting edge 228 with a perpendicular side 220 of adjacent protrusion 214C. In an embodiment, the angled side 218 extends from the base 212 at approximately a thirty-degree angle 222. In another embodiment, the perpendicular side 220 extends at a near perpendicular angle from the base 212.

Figure 7:
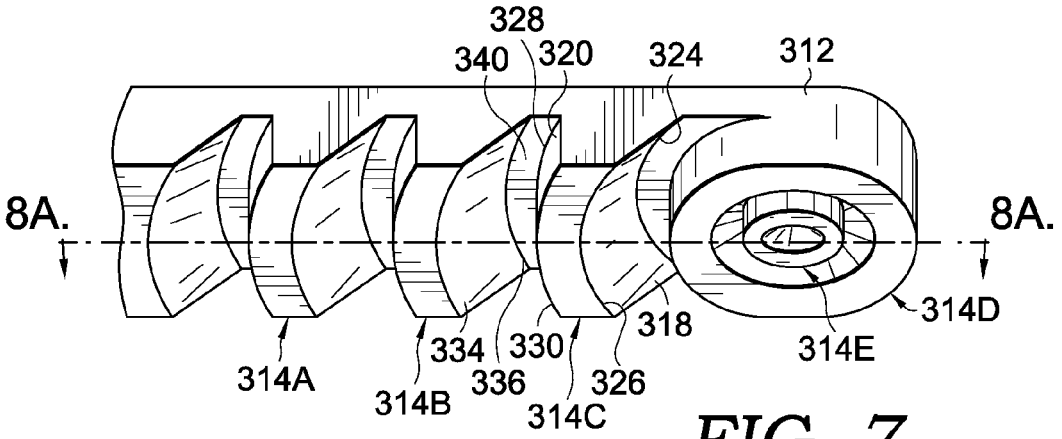
FIG. 7 illustrates, from a perspective view, a portion of a sole in accordance with an embodiment of the invention.
Figure 8A:
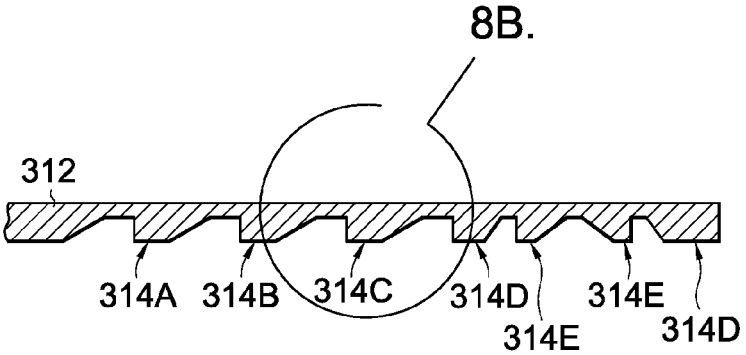
FIG. 8A illustrates a cross-sectional view of the portion illustrated in FIG. 7.
Figure 8B:
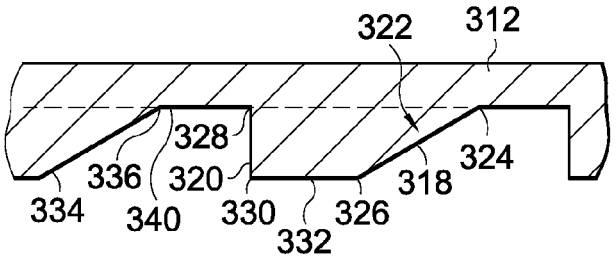
FIG. 8B illustrates a blown-up view of a portion of FIG. 8A.

A further example of a sole in accordance with the present invention is illustrated in FIGS. 7, 8A and 8B, which show protrusion 314C. Protrusion 314C includes various elements. For example, protrusion 314C includes an angled side 318 and a perpendicular side 320. The angled side 318 comprises a first connecting edge 324 adjacent to and extending along the base 312 and a first terminal edge 326 at the opposing edge of the angled side 318 from the first connecting edge 324. Moreover, the perpendicular side 320 comprises a second connecting edge 328 adjacent to and extending along the base 312 and a second terminal edge 330 at the opposing edge of the perpendicular side 318 from the second connecting edge 328. In an embodiment, the angled side 318 may extend from the base 312 at an approximate thirty-degree angle 322. In another embodiment, the perpendicular side 320 may extend at a near perpendicular angle from the base 312.

With continued reference to FIGS. 7, 8A, and 8B, in a further example of a sole in accordance with the present invention a plurality of protrusions 314A-314E are positioned or constructed spaced apart from each other along base 312. For example, protrusion 314B is spaced apart from protrusion 314C such that an angled side of protrusion 314B does not share a connecting edge with protrusion 314C. Instead, angled side 334 of protrusion 314B includes a third connecting edge 336, which does not run along the base 312 consistent with the second connecting edge 328 of the perpendicular side 318 of protrusion 314C. A base-surface side 340 extends between and connects second connecting edge 328 and third connecting edge 336. Moreover, in another exemplary embodiment, protrusion 314C further comprises a surface-facing side 332 extending substantially parallel to the base 312 between the first terminal edge 326 of the angled side 318 and the second terminal edge 330 of the perpendicular side 320.

Figure 9:
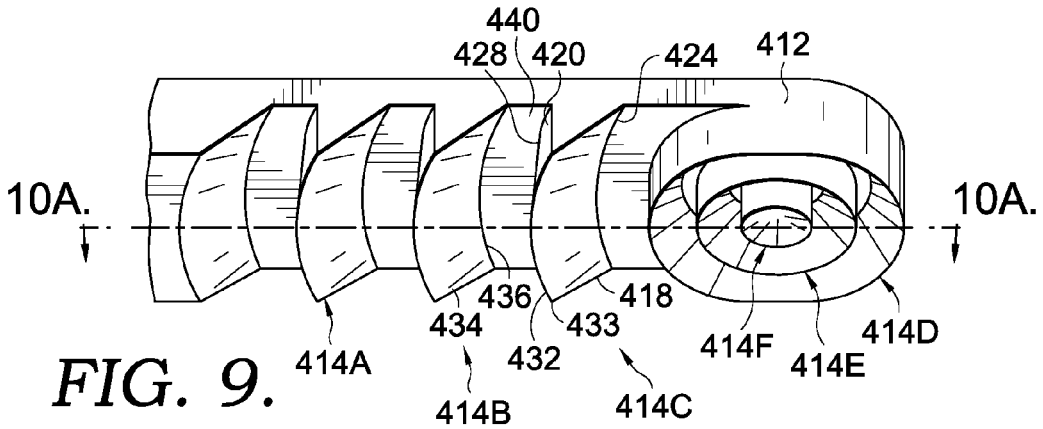
FIG. 9 illustrates, from a perspective view, a portion of a sole in accordance with an embodiment of the invention.
Figure 10A:
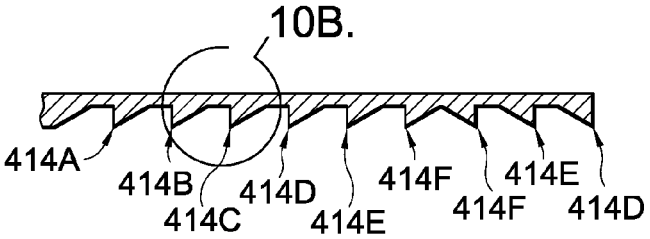
FIG. 10A illustrates a cross-sectional view of the portion illustrated in FIG. 9.
Figure 10B:
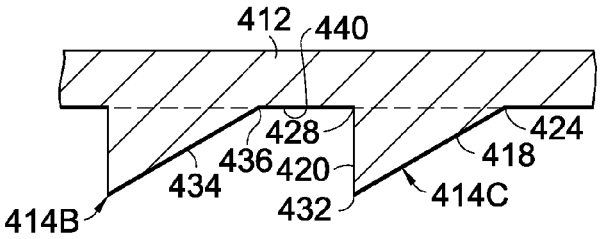
FIG. 10B illustrates a blown-up view of a portion of FIG. 10A.

A further example of a sole in accordance with the present invention is illustrated in FIGS. 9, 10A and 10B, which includes exemplary protrusion 414C. Protrusion 414C includes various elements. For example, protrusion 414C includes an angled side 418 and a perpendicular side 420. The angled side 418 comprises a first connecting edge 424 adjacent to and extending along the base 412. Moreover, the perpendicular side 420 comprises a second connecting edge 428 adjacent to and extending along the base 412. In an embodiment, angled side 418 and perpendicular side 420 terminate at a shared termination edge 432, which is opposite each side's respective connecting edge. As a result, protrusion 414C terminates at a point 433. In a further embodiment, the angled side 418 may extend from the base 412 at an approximate thirty-degree angle. Also, the perpendicular side 420 may extend at a near perpendicular angle from the base 412.

As shown in FIGS. 9, 10A, and 10B, in a further example of a sole in accordance with the present invention a plurality of protrusions 414A-414F may be positioned or constructed spaced apart from each other along base 412. For example, protrusion 414B is spaced apart from protrusion 414C such that an angled side of protrusion 414B does not share a connecting edge with protrusion 414C. Instead, angled side 434 of protrusion 414B includes a third connecting edge 436, which does not run along the base 412 consistent with the second connecting edge 428 of the perpendicular side 418 of protrusion 414C. A base-surface side 440 extends between and connects second connecting edge 428 and third connecting edge 436.

Figure 13:
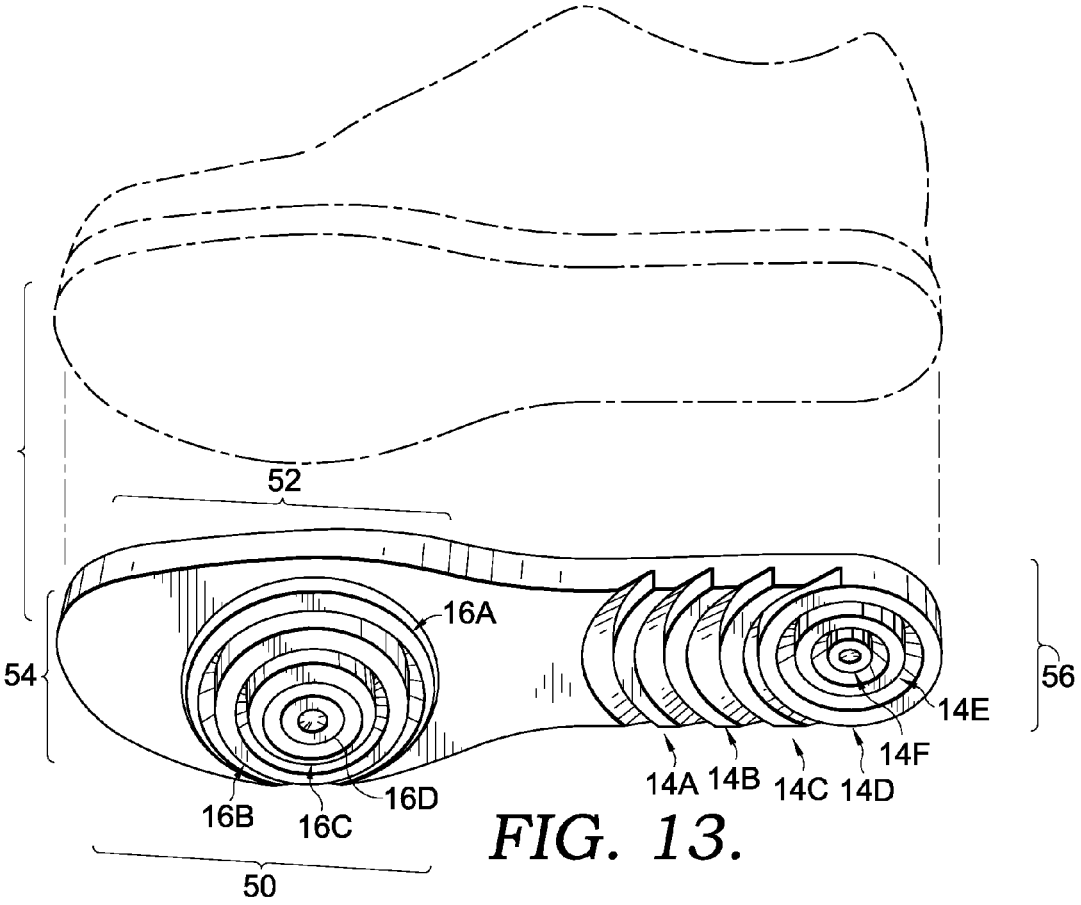
FIG. 13 illustrates a partially exploded view of a shoe in combination with a sole in accordance with an embodiment of the invention, wherein the sole is attachable to the underneath side of a shoe midsole.
Figure 14:
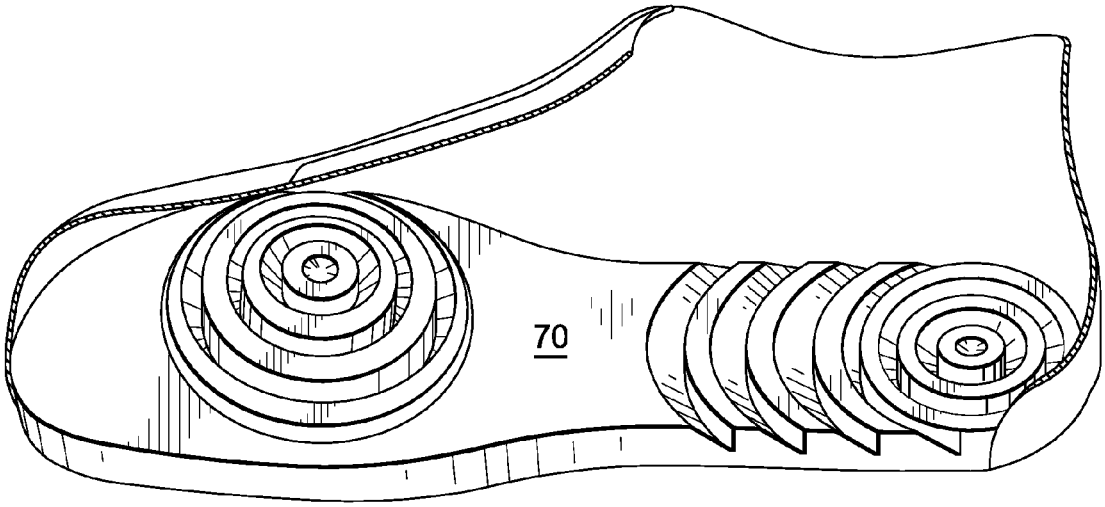
FIG. 14 illustrates, in a partially cut-away view, a shoe in combination with a sole in accordance with an embodiment of the invention, wherein the sole is positionable within a cavity formed by the shoe upper.
Figure 15A:
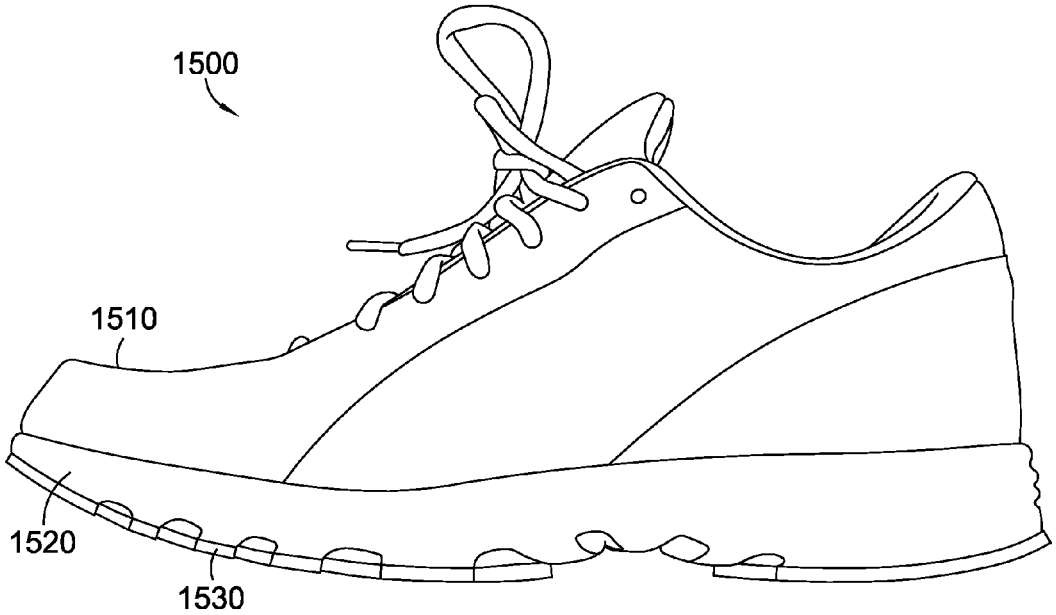
FIGS. 15A-15B illustrate a sole in accordance with the present invention integrated within a shoe as a midsole.
Figure 15B:
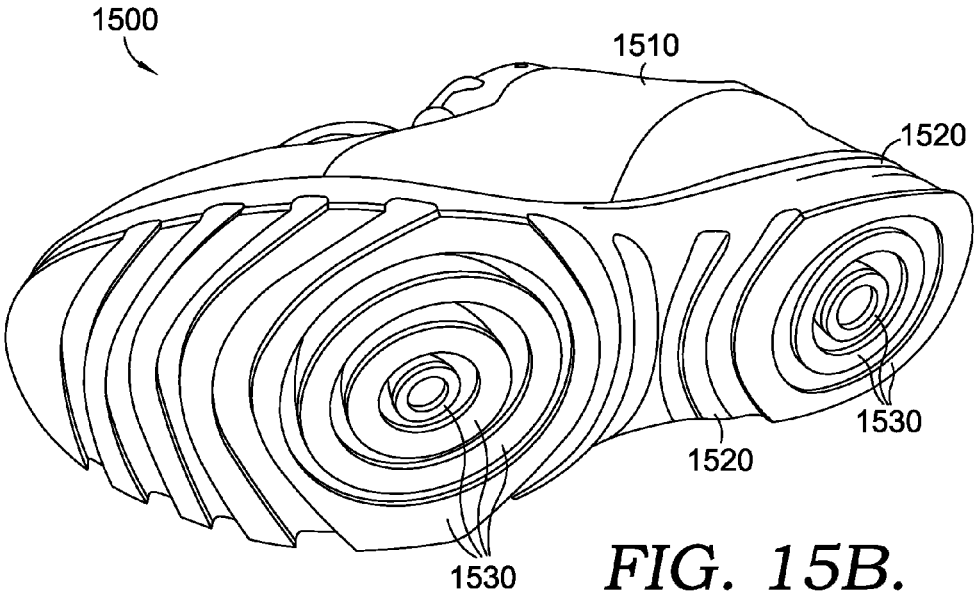

A sole in accordance with aspects of the present invention may include an "as-worn" position and may be combined with a shoe in various manners, such that the sole extends in a substantially planar fashion when the shoe is not flexed. For example, as illustrated in FIG. 13, a sole in accordance with the present invention may be combined with a shoe by attaching the sole to an underneath side of a midsole. In addition, as shown in FIG. 14, a sole may be combined with a shoe by inserting the sole into a cavity formed within the upper of the shoe, wherein the sole is supported on top of a midsole. As shown in FIGS. 15A-15B, a sole in accordance with the present invention may comprise a midsole constructed itself. In an as-worn position, a sole includes portions or sections that correspond with parts of a foot of a wearer of a shoe. For example, parts of a foot may include a medial side, a lateral side, a ball, and a heel. In an as-worn position, portions or sections of a sole correspond with these parts of a wearer's foot to provide additional cushioning.

As shown in at least FIGS. 1 and 13 in examples of a sole in accordance with the present invention, a sole may include a medial side 50 positioned beneath the medial side of the foot in an as-worn position. In addition, a sole may include a lateral side 52 positioned beneath the lateral side of the foot in an as-worn position. A sole may also include a ball portion 54 positioned beneath the ball of the foot in an as-worn position. Furthermore, a sole may include a heel portion 56 positioned beneath the heel of the foot in an as-worn position.

Figure 3:
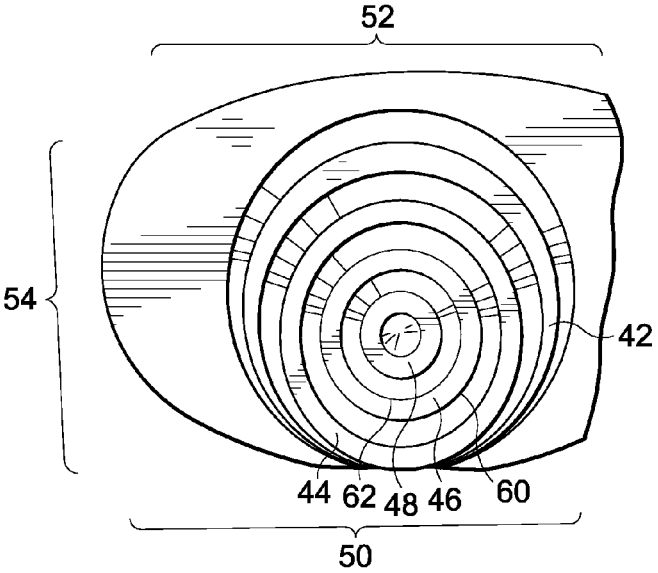
FIG. 3 illustrates, from a direct view, an embodiment of a ball portion of a sole in accordance with an embodiment of the invention.

As seen in FIGS. 1, 3, 13, and 14 the plurality of protrusions may further comprise, at the ball portion 54 of the sole 10, concentrically arranged shapes formed by surface-facing sides 42, 44, 46, and 48. As can be seen in FIG. 3, first terminal edge 60 and second terminal edge 62 may be positioned closer together near the medial side 50 than at the lateral side 52, such that a portion of surface-facing side 46 closest to the medial side 50 is narrower than at the lateral side 52. In another example, concentrically arranged shapes formed by the surface-facing sides 42, 44, and 46 are substantially elliptical. In yet another example of a sole in accordance with the present invention, concentrically arranged shapes comprise at least one circle, such as illustrated by surface facing side 48. Moreover, at least one of the concentrically arranged shapes may be truncated, such as illustrate by surface-facing side 42.

Another example of a sole in accordance with the present invention is shown in at least FIGS. 1, 2, 5, 7 and 9 in which the sole 10 comprises concentrically arranged shapes formed by the surface-facing sides 38, 39 and 40 at the heel portion 56 of the sole 10.

Additional examples of soles in accordance with the present invention may include a sole 10 for cushioning a wearer's foot from impact, wherein the sole 10 includes a base portion 12, a first plurality of concentrically arranged portions, and a second plurality of concentrically arranged portions. An example of a first plurality of concentrically arranged portions is shown in FIG. 1, in which a first plurality of concentrically arranged portions includes 14A-14F. FIG. 1 also illustrates an example of a second plurality of concentrically arranged portions, in which a second plurality of concentrically arranged portions includes 16A-16D. In such an embodiment, the base portion 12 may extend across at least the heel of the wearer's foot and the ball of the wearer's foot in an as-worn position. In addition, the base portion 12 may extend in a substantially planar fashion and have a first surface 70 (FIG. 14) and a second surface 72 (FIG. 1). In a further embodiment the first plurality of concentrically arranged portions 14A-14F is substantially centered on the heel of the wearer's foot in an as-worn position and the second plurality of concentrically arranged portions 16A-16D is substantially centered on the balls of the wearer's foot in an as-worn position.

A first plurality of concentrically arranged portions 14A-14F may extend from at least one of the first surface 70 of the base portion 12 and the second surface 72 of the base portion 12. In addition, a second plurality of concentrically arranged portions 16A-16D may extend from at least one of the first surface 70 of the base portion 12 and the second surface 72 of the base portion 12. In one embodiment the first surface 70 of the base portion 12 comprises a top surface of the base portion 12 and the second surface 72 of the base portion 12 comprises a bottom surface of the base 12, the top surface 70 being more proximate to the wearer's foot than the bottom surface 72 in an as-worn position.

Figure 11:
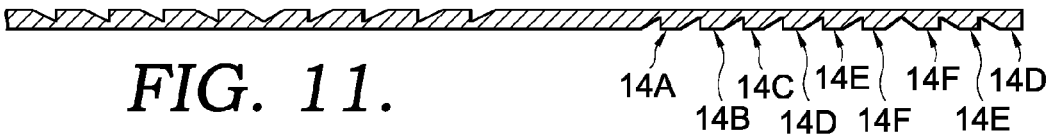
FIG. 11 illustrates a cross-sectional view of a sole in accordance with an embodiment of the present invention.
Figure 12:
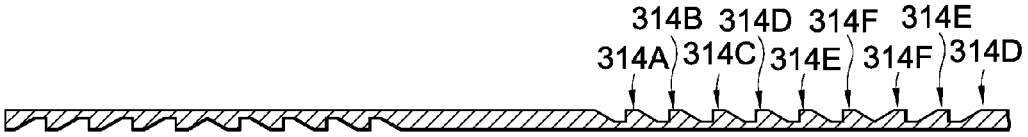
FIG. 12 illustrates a cross-sectional view of a sole in accordance with an embodiment of the present invention.

Examples of a sole of the present invention may include alternative configurations, wherein the first plurality of concentrically arranged portions 14A-14F and the second plurality of concentrically arranged portions 16A-16D may be positioned on the same surface 70 and 72 of the base 12 or may be positioned on opposing surfaces of the base 12. In one exemplary aspect, as shown in FIG. 14, in a sole for cushioning, both a first plurality of concentrically arranged portions and a second plurality of concentrically arranged portions extend from the top surface 70 of the base portion. In another exemplary embodiment, as shown in FIGS. 1 and 13, both the first plurality of concentrically arranged portions 14A-14F and the second plurality of concentrically arranged portions 16A-16D may extend from the bottom surface 72 of the base portion 12. Alternatively, in a version shown in FIG. 11, the first plurality of concentrically arranged portions 14A-14F may extend from a bottom surface 72 of the base and a second plurality of concentrically arranged portions, such as 16A-16D, may extend from the top surface 70 of the base. In contrast, as shown in FIG. 12 the first plurality of concentrically arranged portions 314A-314F may extend from the top surface of the base and the second plurality of concentrically arranged portions, such as 16A-16D, may extend from the bottom surface of the base portion. Although each of FIGS. 1, 4A, 11, 12, 13, and 14 only depict one type of protrusion, it is contemplated that the configuration illustrated in each respective figure might include one or more other types of protrusions.

Referring now to FIGS. 15A and 15B, a sole 1520 in accordance with the present invention integrated into shoe 1500 as a midsole is illustrated. Sole 1520 may be positioned between a shoe upper 1510 and an outsole 1530 to operate as a cushioning midsole. Outsole 1530 may comprise portions of a material such as latex or other durable rubber applied to protrusions of the sole 1520.

Figure 16A:
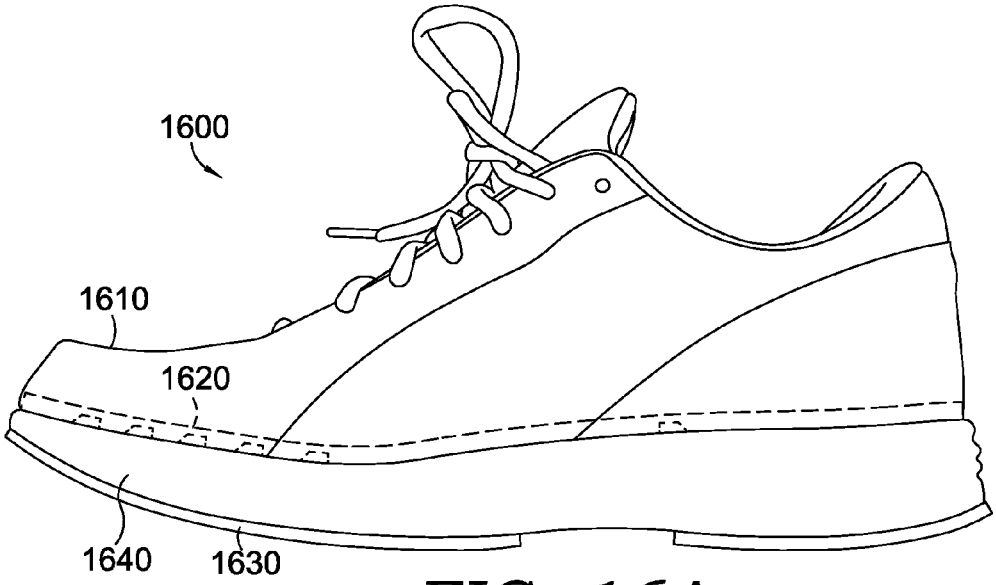
FIGS. 16A-16C illustrate a sole in accordance with the present invention integrated within a shoe as a removable insole.
Figure 16B:
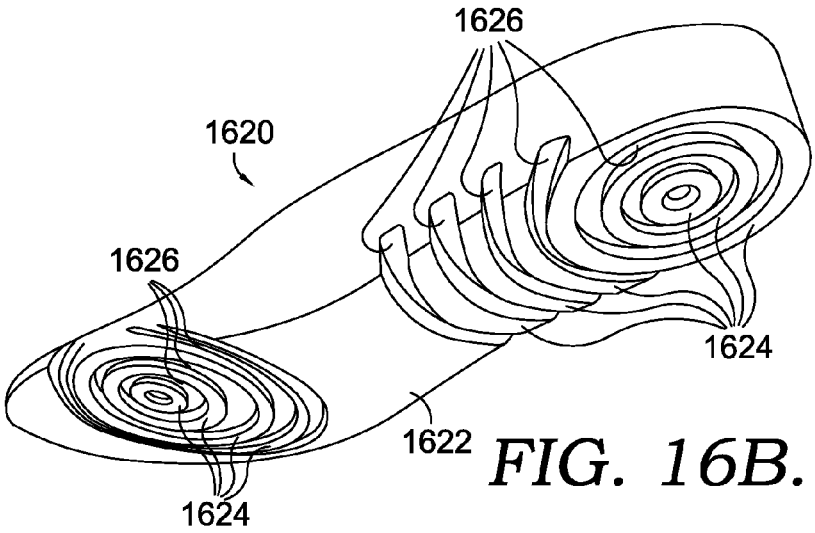
Figure 16C:
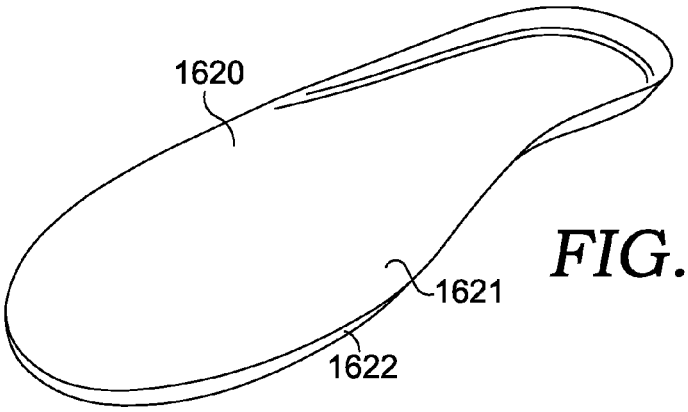

Referring now to FIGS. 16A-16C, a sole 1620 in accordance with the present invention integrated as an insole within a shoe 1600 is illustrated. As illustrated in FIG. 16A, a sole 1620 in accordance with the present invention may be inserted within the upper 1620 of a shoe 1600 to provide cushioning for a wearer. Any form of outsole 1630, which may also include any type of midsole 1640 may be provided as part of shoe 1600.

As illustrated further in FIG. 16B, a sole 1620 in accordance with the present invention used as an insole may provide a plurality of protrusions 1624 and grooves 1626 substantially as described above to provide cushioning for the wearer of a shoe 1600. As illustrated further in FIG. 16C, a sole 1620 in accordance with the present invention utilized as an insole may provide a cushioning component 1622 from which protrusions 1624 and grooves 1626 may be formed. A cover 1621 may contact the foot of the wearer of the shoe 1600. Cover 1621 may be of fabric or other suitable material that may comfortably engage the foot of a wearer (not illustrated), which may be socked or bare.

A sole in accordance with the invention may be constructed of a variety of materials. For example, the sole may be constructed of polyeurothane, phylon, EVA, rubber, etc. Any material may be used in conjunction with the various examples of soles in accordance with the present invention.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, what is claimed is:

1. A sole for cushioning a wearer's foot from impact, the sole comprising:

(a) a base portion extending across at least the heel of the wearer's foot and the ball of the wearer's foot in an as-worn position, the base portion extending in a substantially planar fashion and having a first surface and a second surface;

(b) a first plurality of concentrically arranged portions extending from at least one of the first surface of the base portion and the second surface of the base portion, the first plurality of concentrically arranged portions being substantially centered on the heel of the wearer's foot in an as-worn position, each concentrically arranged portion of the first plurality of concentrically arranged portions comprising:

(i) an angled side extending at an angle from the base to a first terminal edge, (ii) a perpendicular side extending at a near perpendicular angle from the base to a second terminal edge, and (iii) a contact side extending between the first terminal edge of the angled side and the second terminal edge of the perpendicular side; and (c) a second plurality of concentrically arranged portions extending from at least one of the first surface of the base portion and the second surface of the base portion, the second plurality of concentrically arranged portions being positioned along the balls of the wearer's foot in an as-worn position, each concentrically arranged portion of the second plurality of concentric ring portions comprising:

(i) an angled side extending at an angle from the base to a first terminal edge, (ii) a perpendicular side extending at a near perpendicular angle from the base to a second terminal edge, and (iii) a contact side extending between the first terminal edge of the angled side and the second terminal edge of the perpendicular side, and wherein the first terminal edge and the second terminal edge of one of the first plurality of concentrically arranged portions and the second plurality of concentrically arranged portions are positioned closer together at a first side of the sole than at a second side of the sole, whereby the contact side at the first side is narrower than at the second side and wherein the first side of the sole is opposite the second side of the sole.

2. The sole for cushioning of claim 1, wherein, in an as-worn position, the first surface of the base portion comprises a top surface of the base portion and the second surface of the base portion comprises a bottom surface of the base, the top surface being more proximate to the wearer's foot than the bottom surface in an as-worn position, wherein both the first plurality of concentrically arranged portions and the second plurality of concentrically arranged portions extend from the top surface of the base portion.

3. The sole for cushioning of claim 1, wherein, in an as-worn position, the first surface of the base portion comprises a top surface of the base portion and the second surface of the base portion comprises a bottom surface of the base, the top surface being more proximate to the wearer's foot than the bottom surface in an as-worn position, wherein both the first plurality of concentrically arranged portions and the second plurality of concentrically arranged portions extend from the bottom surface of the base portion.

4. The sole for cushioning of claim 1, wherein, in an as-worn position, the first surface of the base portion comprises a top surface of the base portion and the second surface of the base portion comprises a bottom surface of the base, the top surface being more proximate to the wearer's foot than the bottom surface in an as-worn position, wherein the first plurality of concentrically arranged portions extends from the top surface of the base portion and the second plurality of concentrically arranged portions extends from the bottom surface of the base portion.

5. The sole for cushioning of claim 1, wherein, in an as-worn position, the first surface of the base portion comprises a top surface of the base portion and the second surface of the base portion comprises a bottom surface of the base, the top surface being more proximate to the wearer's foot than the bottom surface in an as-worn position, wherein the first plurality of concentrically arranged portions extends from the bottom surface of the base portion and the second plurality of concentrically arranged portions extends from the top surface of the base portion.

6. The sole for cushioning of claim 1, wherein the base attaches to a midsole of a shoe.

7. The sole for cushioning of claim 1, wherein the sole is positioned both inside an upper portion of a shoe and above a midsole portion of a shoe.

8. The sole for cushioning of claim 1, wherein the sole is constructed of at least one material selected from a group of materials comprising polyeurothane, phylon, EVA, and rubber.

9. The sole for cushioning of claim 1, wherein the first plurality of concentrically arranged portions and the second plurality of concentrically arranged portions are elliptical.

10. The sole of claim 9, wherein at least one of the first plurality of concentrically arranged portions and the second plurality of concentrically arranged portions comprise one or more circles.

11. The sole of claim 10, wherein at least one of the first plurality of concentrically arranged portions and the second plurality of concentrically arranged portions is truncated.

12. The sole for cushioning of claim 1, wherein, in an as-worn position, the first surface of the base portion comprises a top surface of the base portion and the second surface of the base portion comprises a bottom surface of the base, the top surface being more proximate to the wearer's foot than the bottom surface in an as-worn position; wherein both the first plurality of concentrically arranged portions and the second plurality of concentrically arranged portions extend from the bottom surface of the base portion; wherein the sole further comprises a third plurality of concentrically arranged portions and a fourth plurality of concentrically arranged portions; and wherein the third plurality of concentrically arranged portions and the fourth plurality of concentrically arranged portions extend from the top surface of the base portion.

13. The sole for cushioning of claim 1, wherein, in an as-worn position, the first surface of the base portion comprises a top surface of the base portion and the second surface of the base portion comprises a bottom surface of the base, the top surface being more proximate to the wearer's foot than the bottom surface in an as-worn position; wherein both the first plurality of concentrically arranged portions and the second plurality of concentrically arranged portions extend from the top surface of the base portion; wherein the sole further comprises a third plurality of concentrically arranged portions and a fourth plurality of concentrically arranged portions; and wherein the third plurality of concentrically arranged portions and the fourth plurality of concentrically arranged portions extend from the bottom surface of the base portion.

14. A shoe sole that extends in a substantially planar fashion in an as-worn position on a foot having an inner side, an outer side, a ball, and a heel, the shoe sole comprising:

(a) a base for attachment to a bottom of a shoe; and (b) a plurality of protrusions projecting from the base and integrally constructed with the base, wherein each of the plurality of protrusions comprises:

(i) an angled side extending at an angle from the base between a first connecting edge and a first terminal edge opposite the first connecting edge, the first connecting edge adjacent to and extending along the base, (ii) a perpendicular side extending at a near perpendicular angle from the base between a second connecting edge and a second terminal edge opposite the second connecting edge, the second connecting edge adjacent to and extending along the base, and (iii) a surface-facing side extending substantially parallel to the base between the first terminal edge of the angled surface and the second terminal edge of the perpendicular surface, (c) wherein in the as-worn position the sole comprises:

(i) an inner side positioned beneath the inner side of the foot in an as-worn position, (ii) an outer side positioned beneath the outer side of the foot in an as-worn position, (iii) a ball portion positioned beneath the ball of the foot in an as-worn position, and (iv) a heel portion positioned beneath the heel of the foot in an as-worn position, and (d) wherein the plurality of protrusions further comprises, at the ball portion of the sole, concentrically arranged shapes formed by the surface-facing sides, wherein the first terminal edge and the second terminal edge are positioned closer together at the inner side than at the outer side, whereby the surface-facing side at the inner side is narrower than at the outer side.

15. The sole of claim 14, wherein the concentrically arranged shapes formed by the surface-facing sides are substantially elliptical.

16. The sole of claim 15, wherein the concentrically arranged shapes comprise at least one circle.

17. The sole of claim 15, wherein at least one of the concentrically arranged shapes is truncated.

18. A sole for cushioning a wearer's foot from impact, the sole comprising:

(a) a base portion extending across at least the heel of the wearer's foot and the ball of the wearer's foot in an as-worn position, the base portion extending in a substantially planar fashion and having a first surface and a second surface;

(b) a first plurality of concentrically arranged portions extending from at least one of the first surface of the base portion and the second surface of the base portion, the first plurality of concentrically arranged portions being substantially centered on the heel of the wearer's foot in an as-worn position, each concentrically arranged portion of the first plurality of concentrically arranged portions comprising:

(i) an angled side extending at an angle from the base to a first terminal edge, (ii) a perpendicular side extending at a near perpendicular angle from the base to a second terminal edge, and (iii) a contact side extending between the first terminal edge of the angled side and the second terminal edge of the perpendicular side; and (c) a second plurality of concentrically arranged portions extending from at least one of the first surface of the base portion and the second surface of the base portion, the second plurality of concentrically arranged portions being positioned along the balls of the wearer's foot in an as-worn position, each concentrically arranged portion of the second plurality of concentric ring portions comprising:

(i) an angled side extending at an angle from the base to a first terminal edge, (ii) a perpendicular side extending at a near perpendicular angle from the base to a second terminal edge, and (iii) a contact side extending between the first terminal edge of the angled side and the second terminal edge of the perpendicular side, (d) wherein, in an as-worn position, the first surface of the base portion comprises a top surface of the base portion and the second surface of the base portion comprises a bottom surface of the base, the top surface being more proximate to the wearer's foot than the bottom surface in an as-worn position, wherein both the first plurality of concentrically arranged portions and the second plurality of concentrically arranged portions extend from the top surface of the base portion, (e) wherein the first terminal edge and the second terminal edge of one of the first plurality of concentrically arranged portions and the second plurality of concentrically arranged portions are positioned closer together at a first side of the sole than at a second side of the sole, whereby the contact side at the first side is narrower than at the second side and wherein the first side of the sole is opposite the second side of the sole.

* * * * *